US006199221B1

(12) United States Patent
Stahlhut

(10) Patent No.: US 6,199,221 B1
(45) Date of Patent: Mar. 13, 2001

(54) FLUSH VALVE

(75) Inventor: Ulrich Stahlhut, Petershagen (DE)

(73) Assignee: Dal-Georg Rost & Sohne Sanitaramaturen GmbH, Estfalica (DE)

( * ) Notice: Subject to any disclaimer, the term of this patent is extended or adjusted under 35 U.S.C. 154(b) by 0 days.

(21) Appl. No.: 09/497,427

(22) Filed: Feb. 3, 2000

(30) Foreign Application Priority Data

Feb. 12, 1999 (DE) ..... 199 05 816

(51) Int. Cl.[7] ..... E03D 1/34
(52) U.S. Cl. ..... 4/391; 4/390; 4/395
(58) Field of Search ..... 4/378, 379, 381, 4/383, 385, 389, 390, 391, 410, 395

(56) References Cited

U.S. PATENT DOCUMENTS

| | | | | |
|---|---|---|---|---|
| 386,918 | * | 7/1888 | Demarest | 4/391 |
| 3,280,407 | * | 10/1966 | Aaron | 4/391 |
| 3,461,465 | | 8/1969 | Fisher . | |
| 4,017,913 | * | 4/1977 | Judd | 4/378 |

FOREIGN PATENT DOCUMENTS

| | | | | |
|---|---|---|---|---|
| 1 097 917 | | 1/1961 | (DE) . | |
| 2187768 | | 9/1987 | (GB) . | |
| 644497 | * | 9/1962 | (IT) | 4/391 |

* cited by examiner

*Primary Examiner*—Henry J. Recla
*Assistant Examiner*—Tuan Nguyen
(74) *Attorney, Agent, or Firm*—Herbert Dubno; Andrew Wilford

(57) ABSTRACT

A flush tank having a downwardly open outlet and a valve for filling the tank with a liquid has a flush valve having a tube fitted to the outlet and having an upper end vertically displaceable in the tank. A float fixed to the tube upper tube end has a buoyancy changeable between a high buoyancy capable of holding the tube upper end above a liquid level in the tank and a low buoyancy insufficient to hold the tube upper end above the liquid level. An actuator connected to the float can temporarily change the float from high buoyancy to low buoyancy and thereby sink the tube upper end below the liquid level and cause the is liquid in the tank to flow through the tube out of the outlet. The float has a lower part annularly surrounding the tube and an upper part formed as an upper space having a large upwardly open mouth level with the upper end of the tube and a small opening below its mouth opening into the tube.

11 Claims, 8 Drawing Sheets

V
1
21
31
300
30
35
20
5
100
330
42
11
32
40
34
33
VI
48
2
22
111
112
220
23
47
470
44
441
46
440
43
451
4
45
110
11

FLUSH VALVE

FIELD OF THE INVENTION

The present invention relates to a flush valve. More particularly this invention concerns such a valve used in a toilet.

BACKGROUND OF THE INVENTION

A standard toilet has a bowl and at a location somewhat above the bowl a tank that normally is full of water that can be released into the bowl to flush the bowl, either through direct displacement or siphon action The tank has a floor with an outlet port that is normally blocked by a ring mounted on an overflow tube whose upper end is above the normal liquid level in the tank. For flushing the overflow tube is raised, thereby allowing the water in the tank to rush out the outlet port while a float attached to the overflow tube holds it up off the outlet port until the tank is substantially empty, whereupon the tube reseats itself and the tank is slowly refilled by a float-controlled fill valve.

Such systems are relatively failure prone. The seal at the outlet port can degrade and allow some leakage with the concomitant waste of water, or it can fail altogether 80 that the tank cannot fill. The overflow tube must align perfectly with the outlet port so that any problem with the mechanism can result in the flush valve not closing properly.

OBJECTS OF THE INVENTION

It is therefore an object of the present invention to provide an improved flush valve.

Another object is the provision of such an improved flush valve which overcomes the above-given disadvantages, that is which is certain to have a long leak-free service life.

SUMMARY OF THE INVENTION

A flush tank having a downwardly open outlet and a valve for filling the tank with a liquid has a flush valve having according to the invention a tube fitted to the outlet and having an upper end vertically displaceable in the tank. A float fixed to the tube upper tube end has a buoyancy changeable between a high buoyancy capable of holding the tube upper end above a liquid level in the tank and a low buoyancy insufficient to hold the tube upper end above the liquid level. An actuator connected to the float can temporarily change the float from high buoyancy to low buoyancy and thereby sink the tube upper end below the liquid level and cause the liquid in the tank to flow through the tube out of the outlet.

Thus the flushing action is simply initiated by temporarily submerging the upper tube end, whereupon water will rush down it and out through the outlet. There is no valve at the outlet; instead the system works with what is in effect a movable overflow. The resultant structure is extremely simple and therefore likely to have a long service life, something that is useful in a standard toilet that must be expected to flush thousands of times without According to the invention the tube is generally cylindrical and stiff and is provided with a roll-up membrane having an upper end secured around the tube near the float and a lower end secured to the tank at the outlet. Alternately the tube is an accordion-type cuff having a lower end fixed to the tank around the outlet and an upper end secured around the tube near the float. The pleats of the accordion structure can be reinforced with wire In accordance with the invention the float has a lower part annularly surrounding the tube and an upper part formed as an upper space having a large upwardly open mouth level with the upper end of the tube and a small opening below its mouth opening into the tube. The lower part can be a foam ring molded unitarily of plastic with the tube. Alternately the lower part is a downwardly open annular lower space. The upper space can annularly surround the tube at the upper edge and be formed by an annular outer wall and an annular inner wall concentric therewith and forming a part of the tube. The small opening is a hole formed below the upper end in the inner wall, more particularly a plurality of upwardly open slots formed in the inner wall.

In another system the upper part is formed as a funnel having an upper edge level with the upper tube end and a lower end in the tube and forming the opening. This funnel is coaxial with the tube. The actuator can include a vertically displaceable rod having a lower end extending down through and generally blocking the opening in only an upper position of the tube. Thus the tube will drop very quickly at the start of the flush for maximum flushing action, but will slow somewhat once the rod pulls out of and unblocks the lower end of the funnel The actuator includes as described above a vertically displaceable actuating rod extending along an upright axis and having an externally accessible upper end and a transversely extending formation engageable vertically downward against the float to submerge same. A spring urges the rod upward. In this system the tube upper end can form a slot through which the rod extends. The rod extends along and is rotatable about a vertical axis, and the rod is provided with a transversely extending stop that can pass axially and vertically through the slot in one angular position of the rod corresponding to a full flush and that is axially engageable with the tube at the slot in another angular position of the rod corresponding to a partial flush. Thus when the tube descends in the partial-flush other position of the rod it comes to rest on and is stopped by the stop.

To adjust the volume of water dispensed in the partial-flush position interengaging formations on the rod and stop axially displace and arrest the stop on the rod. These formations can be screw-threads The transversely extending formation on the rod includes a pair of opposite horizontal arms projecting from the rod. Furthermore the tank has a top wall and the rod has a It button projecting from the top wall and fixed to the upper rod end. In this case the rod is rotatable about its axis in the button and is provided with a pointer. The button is provided with indicia alignable with the pointer to indicate angular position of the rod. Thus the user can select full or partial flush simply by turning the rod to align it with the appropriate indicia.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
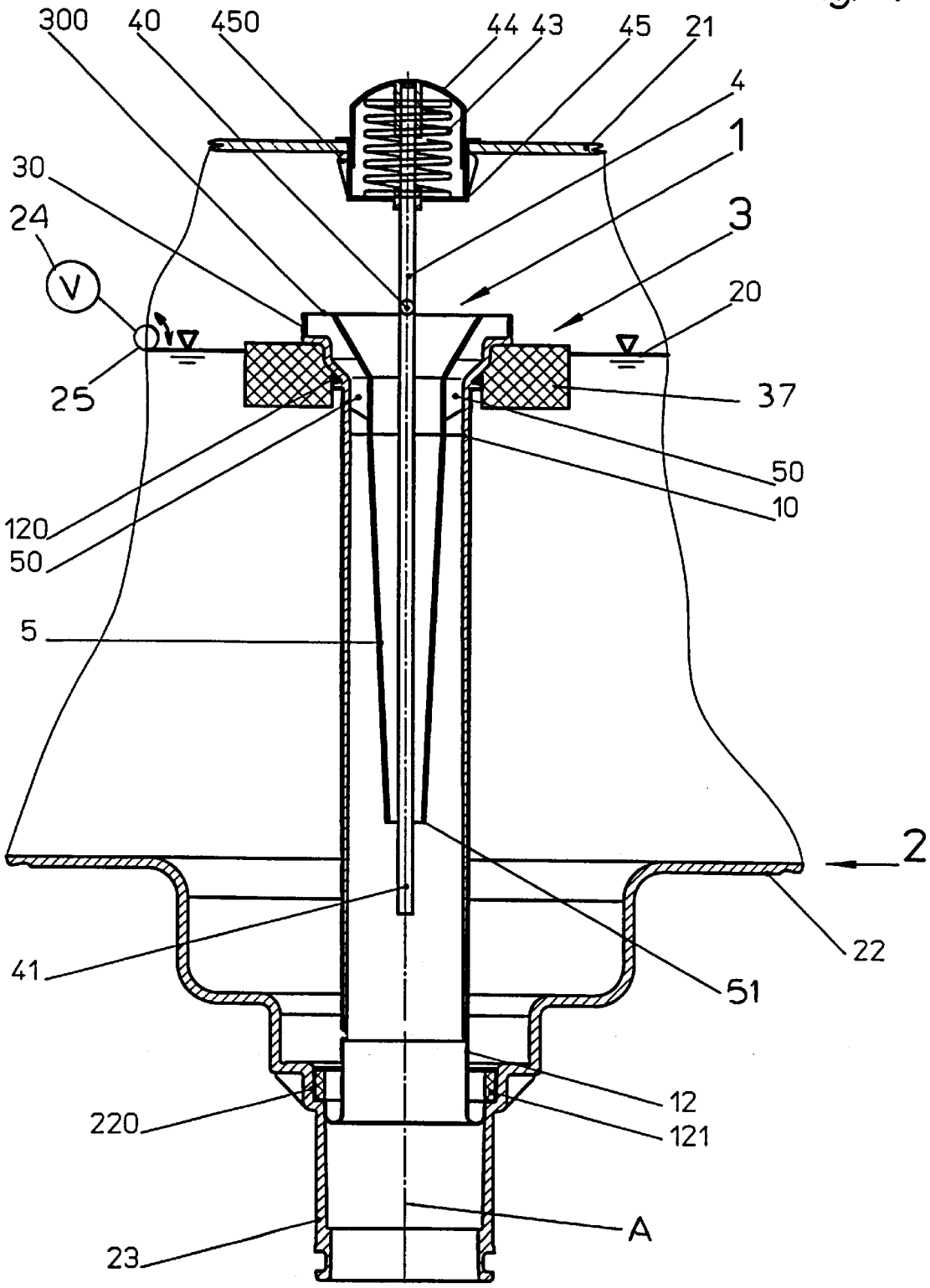
FIG. 1 is a partly schematic vertical section through a first flush valve according to the invention in the full-tank starting position.
Figure 2:
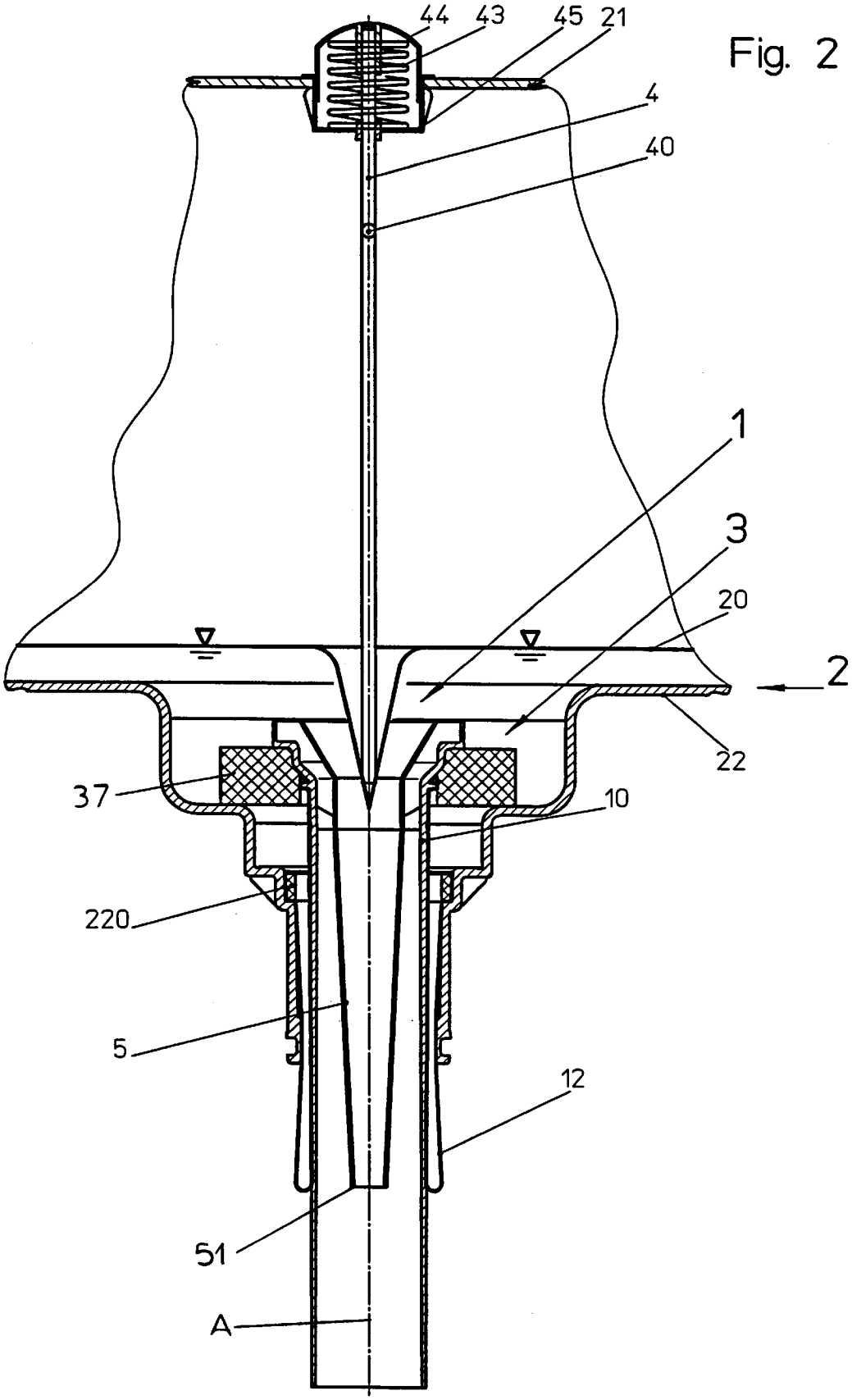
FIG. 2 is a view like FIG. 1 but with the valve near the end of the flush cycle.
Figure 3:
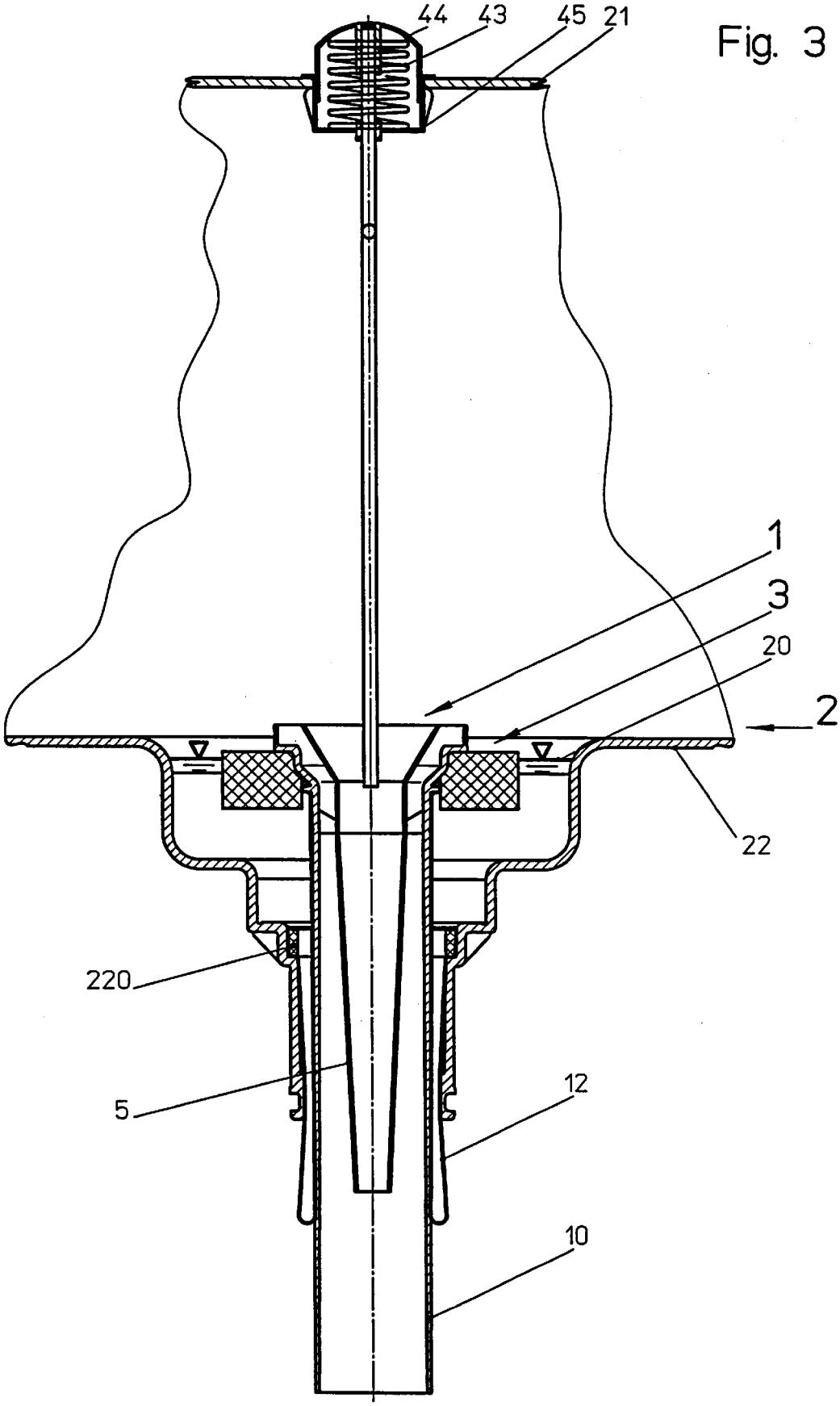
FIG. 3 is a view like FIG. 1 but with the valve starting the refill cycle.

As seen in FIGS. 1 to 3, a toilet flush tank 2 has a top wall or cover 21 and a floor 22 formed with an outlet port or collar 23 centered on a vertical axis A. A diagrammatically illustrated fill valve 24 operated by a float 25 serves to fill this tank 2 to a level 20. The tank floor 22 is formed around the outlet port 23 with a recess 220 in which a lower end of a tubular membrane 12 is secured by a ring 121. An upper end of this membrane 12 is secured at a seal ring 120 inside a foam-rubber float ring 37 secured around the upper end of a drain tube 10 vertically displaceable along the axis A.

Inside the drain tube 10 is a coaxial funnel 5 secured in place by vertical ribs 50 and having a small-diameter lower end 51. The tube 10 has an upper collar 30 defining an upper edge 300 level with the upper edge of the funnel 5 and normally positioned somewhat above the liquid level 20. The ring 37 is itself not sufficiently buoyant to support the tube 10 and funnel 5 unless the tube 10 and funnel 5 are full of air. When the tube 10 and fennel 5 are filled with air they form together with the ring a float 3 that can hold the edge 300 above the level 20.

An actuating rod 4 extends vertically along the axis A down through the funnel 5 inside the tube 10 and has an upper end fixed to a button 44 held in a guide sleeve 45 secured by spring arms 450 to the tank lid 21. A compression spring 43 between the tube 45 and the button 44 urges the rod 4 and button 44 upward The rod 4 is provided with crosspiece arms 40 that can engage the upper edge 300.

In the normal full standby position shown in PIG. 1 the interior of the tube 1 and funnel 5 are both empty and the arms 40 sit on the edge 300. The membrane 12 prevents any leakage between the tube 10 and the outlet port 23. A lower end 41 of the rod 4 generally blocks the lower end of the funnel 5.

To flush, the button 44 is depressed- This action engages the arms 40 against the edge 300 and pushes it under the level 20 so the water in the tank can run in over the edge 300. As soon as this happens the funnel 5 and tube 10 fill with water and the float 3 sinks. At the same time flow down through the tube 10, as well as the slower flow through the funnel 5, rushes out the outlet 23 to flush the toilet associated with the tank 2 and the downward friction of this water in the tube 10 and funnel 5 further pushes the float 3 down. The liquid level 20 will drop very rapidly at the start of the flush because the entire funnel 5 will be full of water since its lower end is generally blocked by the rod 4. The float 3 will as shown in FIG. 2 eventually come to rest on the floor 22, but will stay submerged so long as water runs into the flared upper end of the funnel 5.

Once so much liquid has drained out of the tank 2 that it is no longer getting into the funnel 5, this funnel 5 will drain to increase the buoyancy of the float 3 and the float ring 37 will lift the tube 10 back up as shown in FIG. 3, with the edge 300 above the liquid level 20. Thereafter filling of the tank 2 by the valve 24 will proceed until the parts have reassumed the position of FIG. 1.

Figures 4, 5, 6:
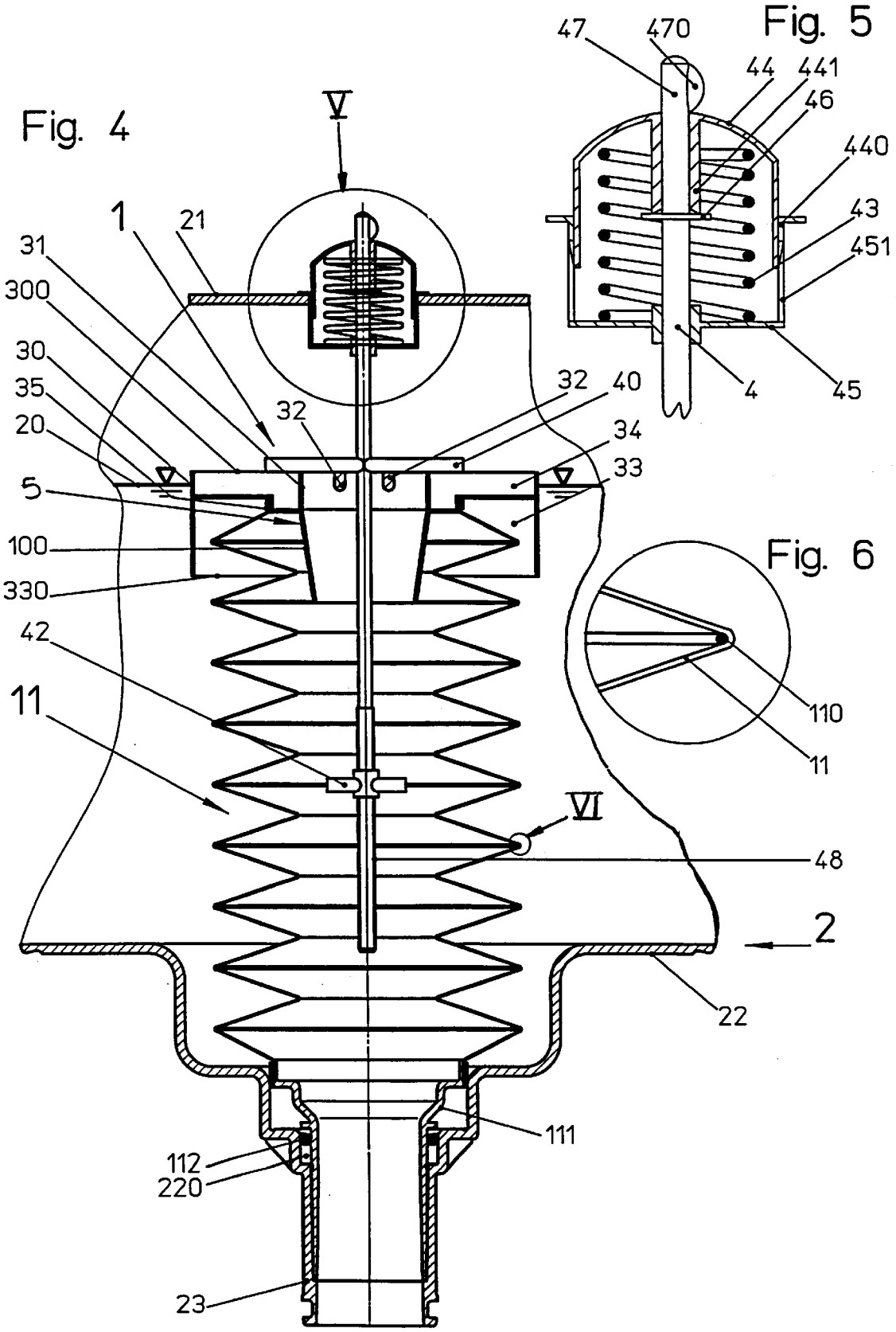
FIG. 4 is a vertical section through a second flush valve in accordance with the invention in the full-tank starting position.
FIGS. 5 and 6 are large-scale views of the details indicated at V and VI in FIG. 4.
Figure 7:
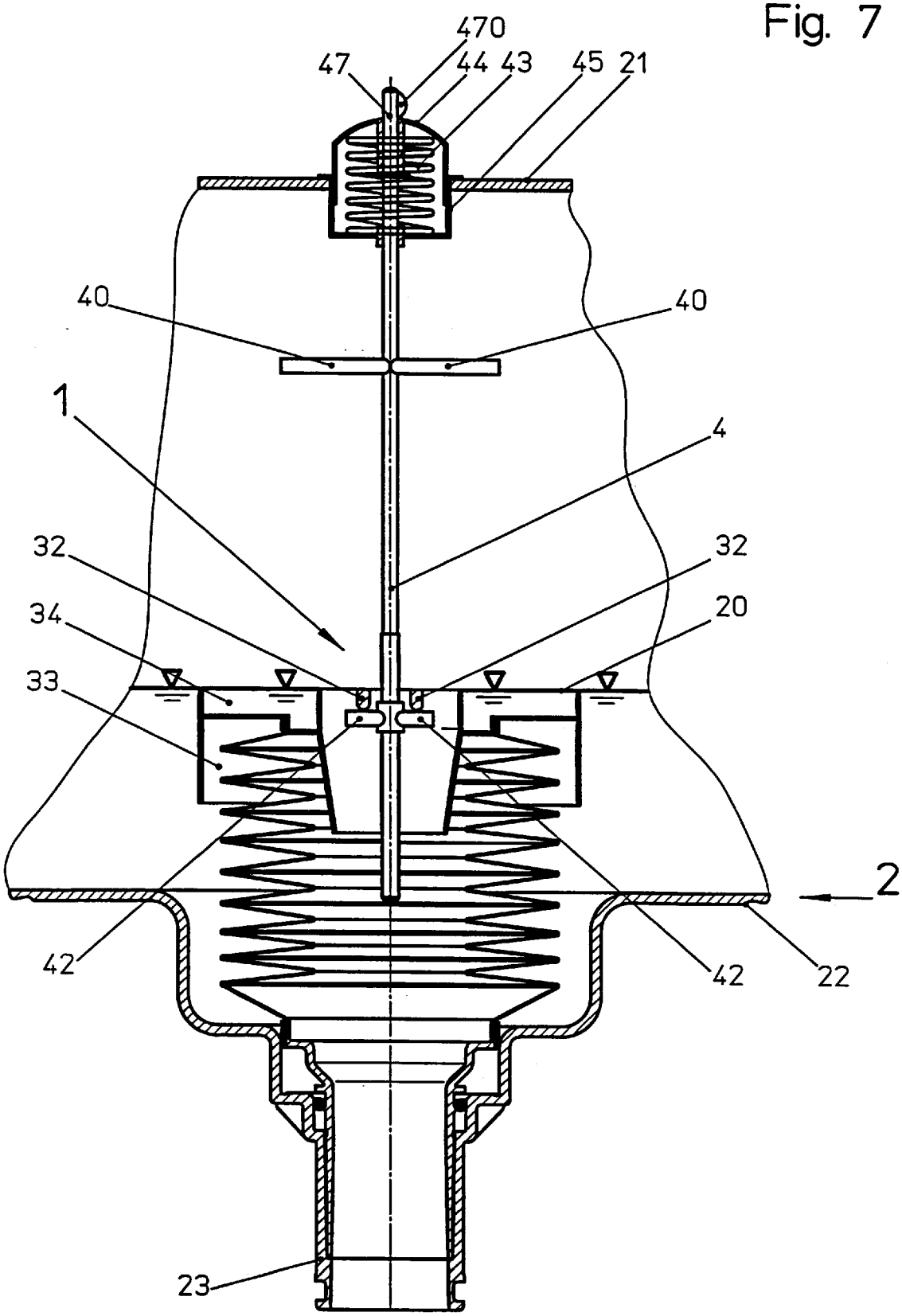
FIGS. 7 and 8 are views like FIG. 4 of the second valve in partial-flush and full-flush positions.

In the arrangement of FIGS. 4 to 12 the tube 10 is formed by an accordion-type cuff 11 having a lower end fitted to a rigid tube 111 fitted into the port 23 and sealed relative thereto by an O-ring 112. As shown in FIG. 6 a wire reinforcement 110 makes the accordion cuff or sleeve 11 hold its shape. The float 3 (see FIGS. 10 to 12) is formed by a plastic or sheet-metal cylindrical outer wall 30 and an integral central funnel 5 together forming with an annular horizontal web 36 a downwardly open annular space 33 and an upwardly open annular space 34 that also opens radially inward into a cylindrical upper portion 31 of the funnel 5 through small notches or passages 310 formed in the funnel 5 above its downwardly tapered lower portion 100. A pair of parallel but spaced horizontal ribs 32 extend across the upper end of the funnel 5 to either side of the central axis A. The upper end of the accordion cuff 11 is connected to an offset portion 35 at the inner periphery of the wall 36. Only when both of the spaces 33 and 34 are filled with air does the float 3 here have sufficient buoyancy to hold the edge 300 above the level 20.

The rod 4 here as shown in FIGS. 13 to 17 has a threaded lower portion 48 extending through a threaded hole 420 of a hub 421 of a crosspiece 42 engageable through a slot formed between the ribs 32. The pitch of the threads of the portion 48 is quite shallow to prevent axial pressure on the crosspiece 42 from axially shifting it although a set screw could be used to arrest the hub 421 on the rod 4. Upward of the threaded portion 48 the rod 4 carries the transverse arms 40 which can engage the upper edge 300 of the float 3 as in FIGS. 1 to 3 and above this an extension piece 47 of the same diameter is secured. This extension piece 47 has a lower end extending through a stop washer 46 and threaded into the upper end of the rod 4 and is formed at its upper end with a radially outwardly projecting and axially elongated pointer tab 470.

Figure 19:
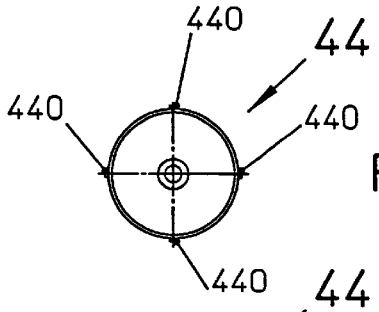
FIGS. 19 and 20 are bottom and top views of the button of FIG. 18.
Figure 18:
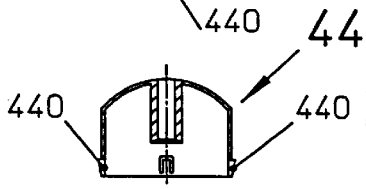
FIG. 18 is a vertical section through the actuating button of FIG. 4.
Figure 20:
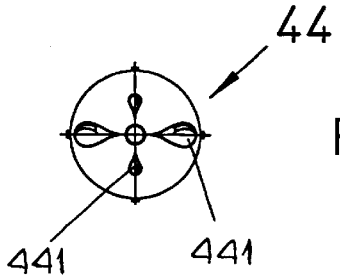
Figure 22:
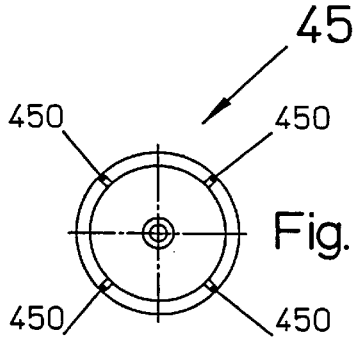
FIGS. 22 and 23 are top and bottom views of the guide sleeve of FIG. 21.
Figure 21:
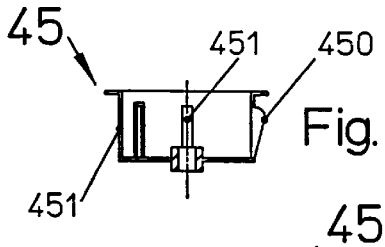
FIG. 21 is a vertical section through the guide sleeve for the actuating button.
Figure 23:
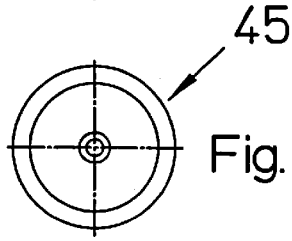

The button 44 as shown in FIGS. 18 to 20 has radially projecting tabs 440 that engage in axially downwardly open slots 451 of the guide shell 45 to retain the two parts 44 and 45 together. In addition as shown in FIG. 5 the button 44 is formed with a central guide sleeve 441 in which fits the extension piece 47 and against the lower end of which the washer 470 engages. Thus the button 44 is captured between the tab 46 and the washer 46 so that it is axially fixed on the rod 4, and the spring 43 urging the button 44 and guide 45 apart therefore urges the button 44 upward.

Figures 8, 9:
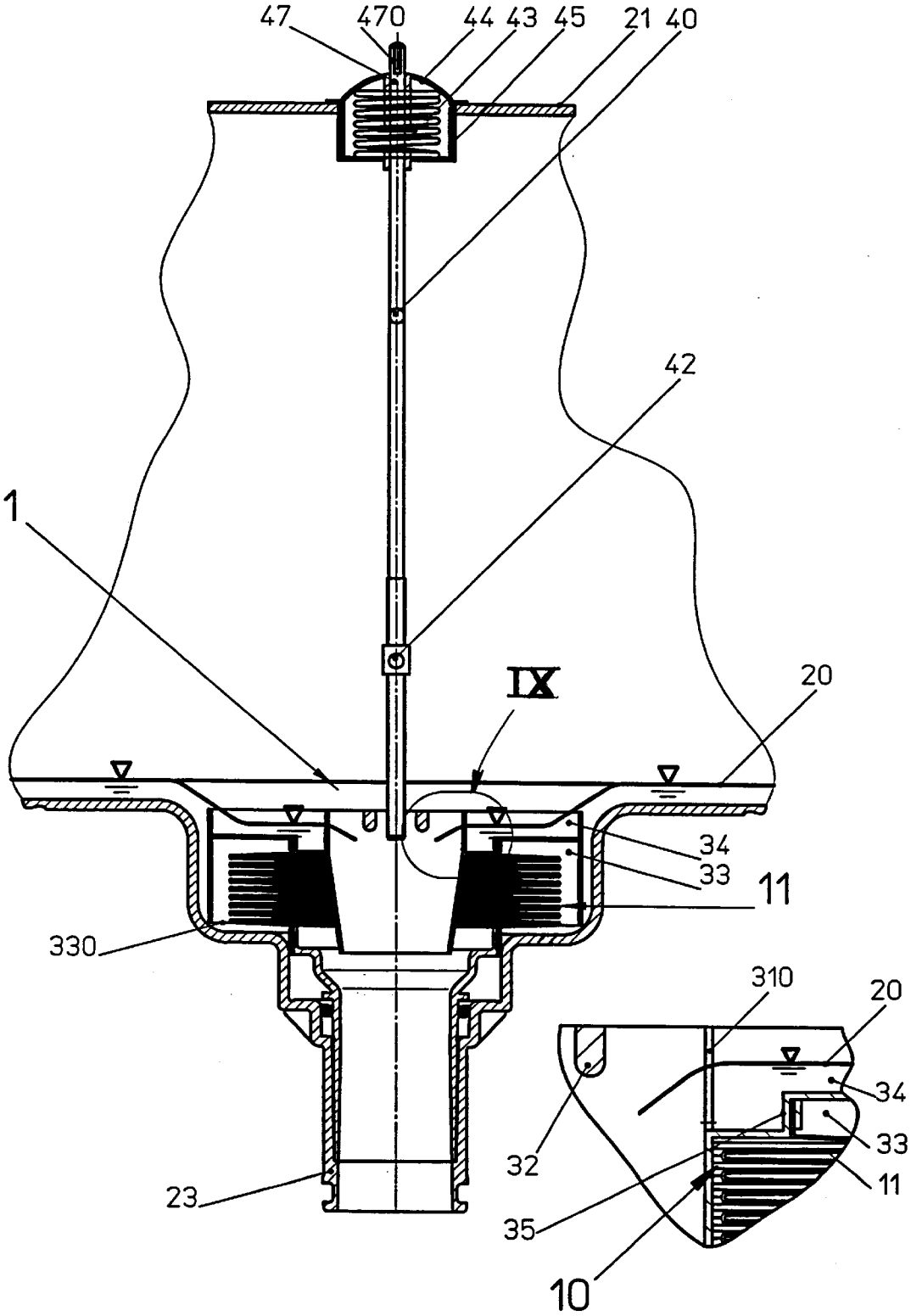
FIG. 9 is a large-scale view of the detail indicated at IX in FIG. 8.
Figure 11:
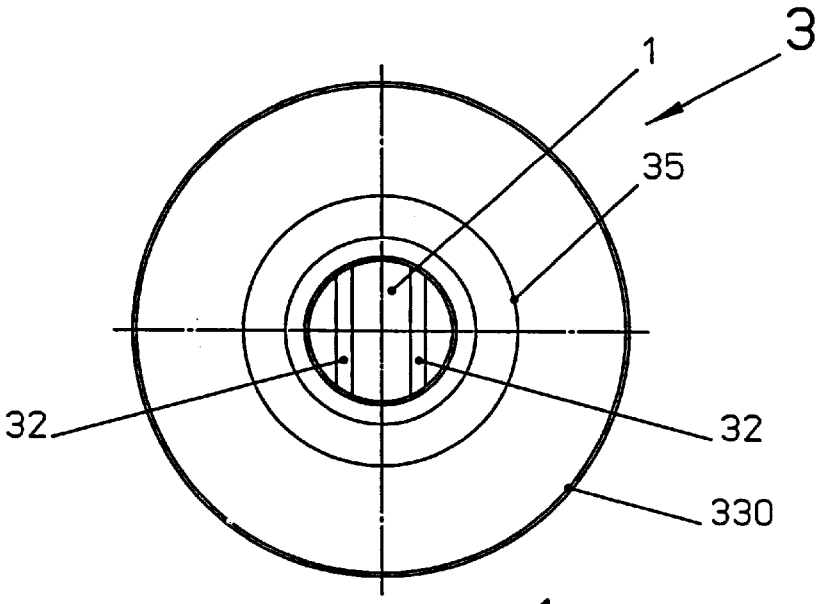
FIGS. 11 and 12 are bottom and top views of the tube of FIG. 10.
Figure 10:
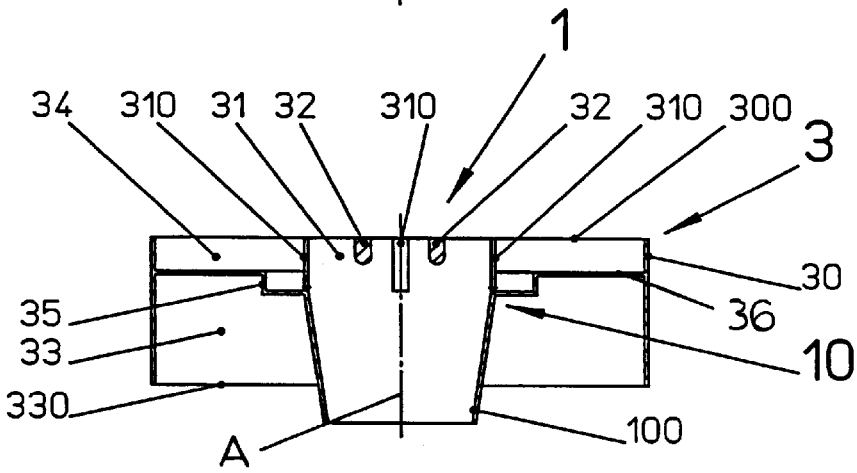
FIG. 10 is a vertical section through the flush tube of FIG. 4.
Figure 12:
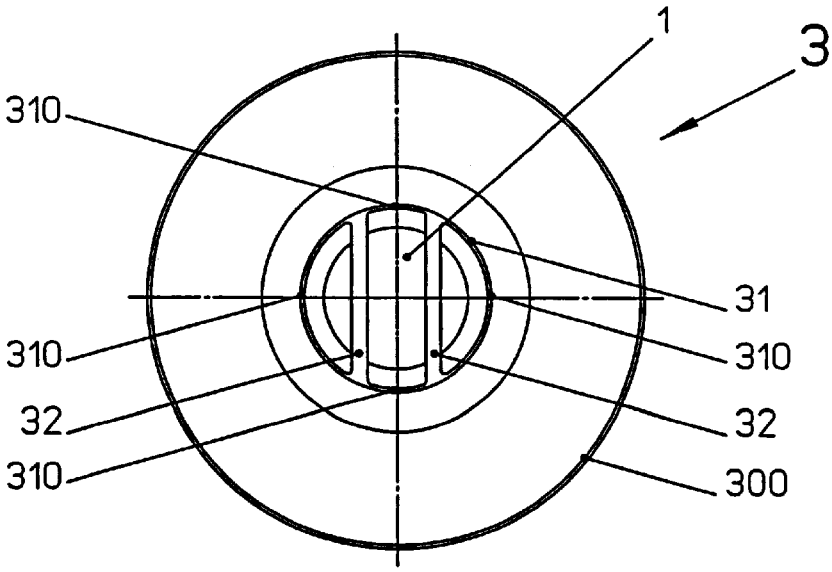
Figure 15:
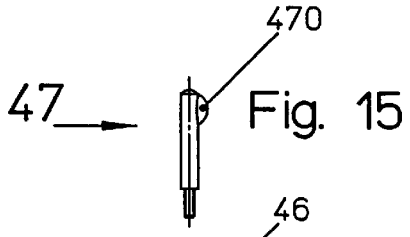
FIG. 15 is a side view of the top part of the actuating rod.
Figure 13:
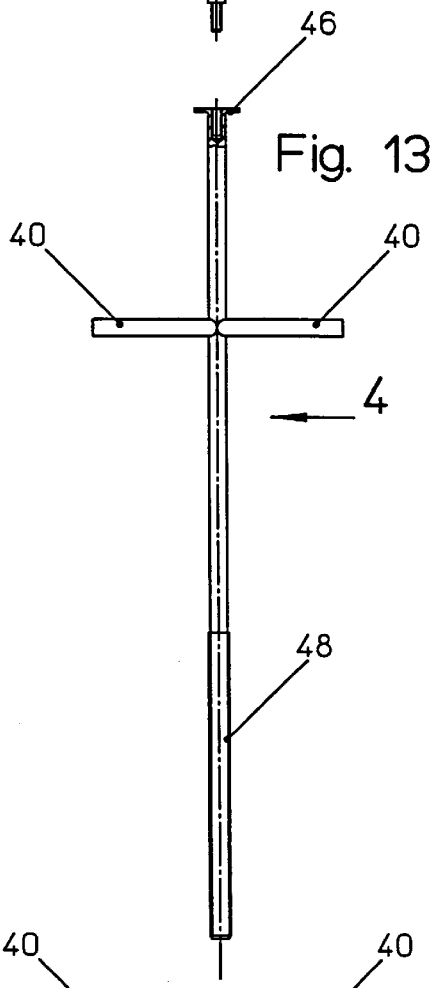
FIG. 13 is a side view of the actuating rod of the FIG. 4.
Figure 14:
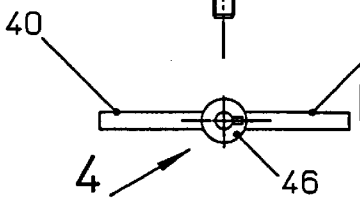
FIG. 14 is a top view of the actuating rod.
Figure 16:
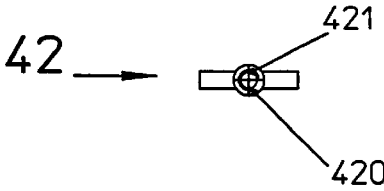
FIGS. 16 and 17 are top and side views of the stroke-limiting crosspiece of the actuating rod.
Figure 17:
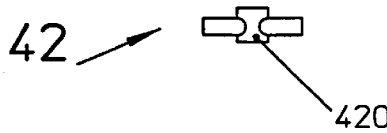

With this system the space 33 traps air so that normally the parts are in the position of FIG. 4. The rim 300 is above the level 20 so that the upwardly open space 34 is empty also. Any downward pressure on the button 44 (The depressed position is shown in FIG. 8.) will push the rim 300 below the level 20 and cause the space 34 to fill up, reducing the buoyancy of the float 3 such that it sinks, collapsing the accordion tube 11 axially. The water in the space 34 will be able to leak slowly through the opening formed by the slots 310 into the funnel 5, but incoming water will replenish this leakage so long as the edge 300 is below the level 20. The water in the tank 2 will pour through the funnel 4 into the outlet 23.

If the crosspiece 42 is oriented crosswise to the ribs 32, the sleeve 11 will stop collapsing once these ribs 32 come to rest on the crosspiece 42. Once the water level 20 reaches the edge 300 and no more water enters the space 34, this space 34 will therefore drain via the slots 310 (see FIG. 9). The buoyancy of the float 3 will increase and it will rise back up as the tank 2 is refilled, since normally the refill valve 24 is opened to fill the tank 2 so long as the float 3 is below the upper position of FIG. 4. The fill rate via the valve 24 is less than the rate at which liquid drains through the from opening formed by the lower end 51 so that the float 3 will lift its edge 300 above the level 20 and start to float back up as the level 20 rises. This is therefore a partial flush which can be used for getting rid of liquid-only wastes when water is to be conserved. The volume of water dispensed in such a partial flush can be controlled by changing the position of the crosspiece 42 on the rod 4, by screwing it upward to decrease and downward to increase the flush volume.

If the crosspiece 42 is oriented parallel to the ribs 32, the sleeve 11 will collapse with the crosspiece 42 passing through the slot defined by the ribs 32 until a bottom edge 330 of the float 3 is sitting on the floor of the tank 2, here at the base of the recess 220. The fill rate via the valve 24 is less than the rate at which liquid drains through the slots 310 so that the float 3 will lift its edge 300 above the level 20 and start to float back up as the level 20 rises. This is a full flush.

The top of the button 44 can carry indicia 441 indicating the direction to point the tab 470 for a full or partial flush. Here an image of a large drop of water indicates a full flush and a small drop a partial one.

I claim:

1. In combination with a flush tank having a downwardly open outlet and means for filling the tank with a liquid, a flush valve comprising:

a tube fitted to the outlet and having an upper end vertically displaceable in the tank and a lower end;

a float fixed to the tube upper end and having a buoyancy changeable between a high buoyancy capable of holding the tube upper end above a liquid level in the tank and a low buoyancy insufficient to hold the tube upper end above the liquid level; and actuating means connected to the float for temporarily changing the float from high buoyancy to low buoyancy and thereby sinking the tube upper end below the liquid level and causing the liquid in the tank to flow through the tube out of the outlet, the lower end of the tube being vertically movable with respect to the is liquid level and extensible through the downwardly open outlet when the liquid is being drained from the tank.

2. The flush valve defined in claim 1 wherein the tube is generally cylindrical and stiff and is provided with a roll-up membrane having an upper end secured around the tube near the float and a lower end secured to the tank at the outlet.

3. The flush valve defined in claim 1 wherein the float has a lower part annularly surrounding the tube and an upper part formed as an upper space having a large upwardly open mouth level with the upper end of the tube and a small opening below its mouth opening into the tube.

4. The flush valve defined in claim 3 wherein the lower part is a foam ring.

5. The flush valve defined in claim 3 wherein the upper part is formed as a funnel having an upper edge level with the upper tube end and a lower end in the tube and forming the opening.

6. The flush valve defined in claim 5 wherein the funnel is coaxial with the tube.

7. The flush valve defined in claim 5 wherein the actuating means includes a vertically displaceable rod having a lower end extending down through and generally blocking the opening in only an upper position of the tube.

8. The flush valve defined in claim 3 wherein the actuating means includes a vertically displaceable actuating rod extending along an upright axis and having an externally accessible upper end and a transversely extending formation engageable vertically downward against the float to submerge same.

9. The flush valve defined in claim 8 wherein the actuating member includes a spring urging the rod upward.

10. The flush valve defined in claim 8 wherein the or transversely extending formation includes a pair of opposite horizontal arms projecting from the rod.

11. The flush valve defined in claim 8 wherein the tank has a top wall and the rod has a button projecting from the top wall and fixed to the upper rod end.

* * * * *